United States Patent [19]

Kolanko

[11] Patent Number: 5,015,942

[45] Date of Patent: May 14, 1991

[54] POSITIVE TEMPERATURE COEFFICIENT CURRENT SOURCE WITH LOW POWER DISSIPATION

[75] Inventor: Frank J. Kolanko, Greenville, R.I.

[73] Assignee: Cherry Semiconductor Corporation, East Greenwich, R.I.

[21] Appl. No.: 534,770

[22] Filed: Jun. 7, 1990

[51] Int. Cl.[5] ..... G05F 3/16; G09G 3/14; G09G 3/32

[52] U.S. Cl. ..... 323/315; 323/907; 340/762; 340/782; 340/815.03

[58] Field of Search ..... 323/312, 313, 314, 315, 323/316, 317, 907; 340/762, 782, 815.03

[56] References Cited

U.S. PATENT DOCUMENTS

| | | | |
|---|---|---|---|
| 4,475,077 | 10/1984 | Nagano | 323/312 |
| 4,808,908 | 2/1989 | Lewis et al. | 323/313 |
| 4,816,742 | 3/1989 | van de Plassche | 323/314 |
| 4,958,122 | 9/1990 | Main | 323/315 |

*Primary Examiner*—William H. Beha, Jr.
*Assistant Examiner*—Nilay H. Vyas
*Attorney, Agent, or Firm*—Robert M. Asher

[57] ABSTRACT

A positive temperature coefficient current source having reduced reference current requirements. The output transistors are each buffered by another transistor in a Darlington pair configuration. The reference current required for the circuit is reduced while maintaining a positive temperature coefficient for the current source.

7 Claims, 1 Drawing Sheet

POSITIVE TEMPERATURE COEFFICIENT CURRENT SOURCE WITH LOW POWER DISSIPATION

BACKGROUND OF THE INVENTION

In the design of integrated circuits, it is sometimes necessary to use a current source that has a positive temperature coefficient. That is, as the temperature increases, the current level output increases also. One application for such a current source is in the drive for light emitting diodes. Since the brightness of a light emitting diode decreases as the temperature goes up, it is desirable to compensate for this with an increased current as the temperature rises as well.

In FIG. 1, a typical positive temperature coefficient current source is shown. The desired drive current for a light emitting diode is 10mA. To achieve the desired current output in the prior art circuit, the resulting base current needed for transistor N3 if it has a current gain of 100 is 100 microamps. In order for the circuit to operate properly, the current through transistor N1 must be greater than the base current of N3.

It is an object of the present invention to lower the current level required by transistor N1. By lowering the input current level, the power dissipation in the integrated circuit is correspondingly lowered. And yet the positive temperature coefficient characteristics of the current source are maintained.

Referring in greater detail to the circuit of FIG. 1, the output current has a positive temperature coefficient. The voltage generated across the resistor R1 is determined by the difference in base emitter voltages of the transistors N3 and N6. The variation in base emitter voltages is created by the difference in emitter areas between the two transistors. The emitter area of transistor N4 is six times the emitter area in transistor N3. The equation for this circuit is $Vbe(N1)+Vbe(N6)+V(R1)=Vbe(N4)+Vbe(N3)$. Because the collector current of N1 and transistor N4 are nearly equal, they can be subtracted from the equation. This leaves: $Vbe(N6)+V(R1)=Vbe(N3)$. Thus, it is seen that the voltage across resistor R1 is equal to the base emitter voltage of transistor N3 minus the base emitter voltage of transistor N6. Since the collector currents of transistors N3 and N6 are nearly equal, the difference in base emitter voltages can be determined from the ratio of the emitter areas of the two devices. More specifically, $Vbe=(kT/Q)\ \ln(A_eN6/A_eN3)$. Where k is the Boltzmann's constant, T stands for temperature and Q is the charge on an electron. $A_e$ stands for the area of the emitters so that the natural log is being taken of the ratio of the emitter areas of transistors N6 and N3. The output current Iout will be equal to the difference in base emitter voltages of transistors N6 and N3 divided by the resistance of resistor R1. With a typical design using shallow N+ as the resistive material for resistor R1, the numerator, Vbe will rise faster than the denominator, the resistance of R1, as temperature increases. Therefore, the output current will rise as temperature rises.

SUMMARY OF THE INVENTION

The present invention is directed to a positive temperature coefficient current source having a significantly lower reference current requirement The circuit includes:

a first transistor having a collector for receiving a reference current, a base connected to the collector and an emitter;

a second transistor having a base connected to the base of said first transistor, a collector and an emitter;

a third transistor having a base connected to the emitter of said second transistor, a collector connected to the collector of said second transistor and an emitter;

a fourth transistor having a collector connected to the emitter of said first transistor, a base connected to the emitter of said third transistor and an emitter connected to ground;

a fifth transistor having a base connected to the emitter of said first transistor, a collector and an emitter;

a sixth transistor having a base connected to the emitter of said fifth transistor, a collector connected to the emitter of said third transistor and an emitter; and a resistor connected between the emitter of said sixth transistor and ground.

Other objects and advantages of the present invention will become apparent during the following description of the presently preferred embodiment of the invention taken in conjunction with the drawings.

DETAILED DESCRIPTION OF THE PREFERRED EMBODIMENT

Figure 1:
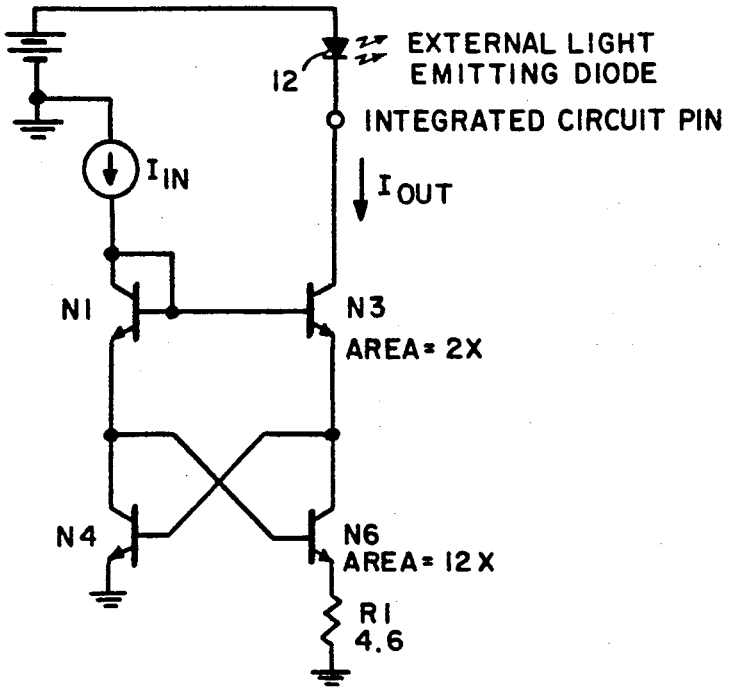
FIG. 1 PRIOR ART
FIG. 1 is a schematic diagram of a positive temperature coefficient current source of the prior art.
Figure 2:
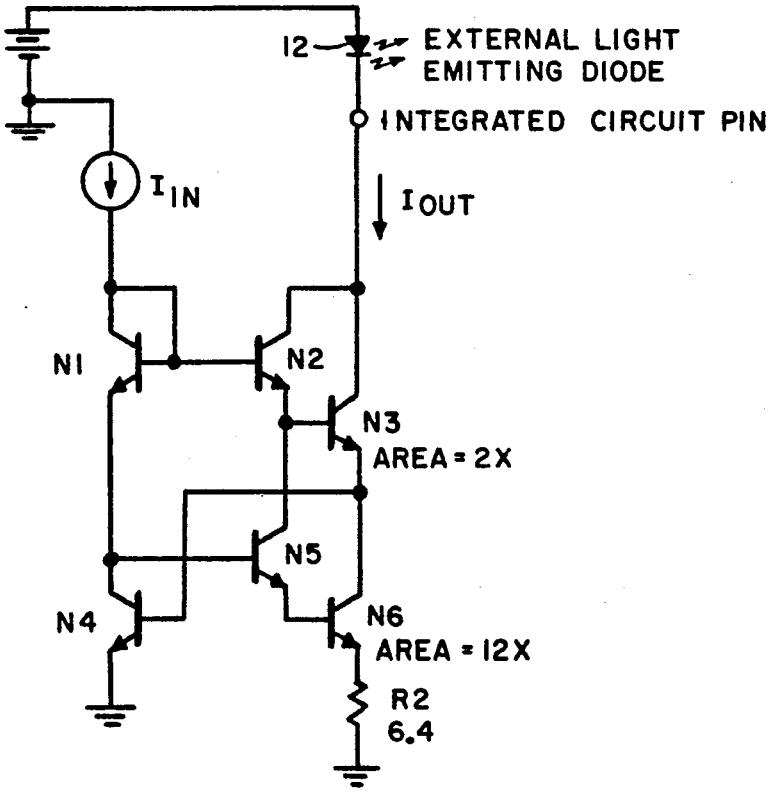
FIG. 2 is a schematic diagram of a positive temperature coefficient current source of the present invention.

Referring now to FIG. 2, the circuit of the present invention is illustrated. A reference current Iin is provided to the collector of transistor N1. The base of transistor N1 is connected to its collector. The emitter of transistor N1 connects to the base of transistor N5 and to the collector of transistor N4. The emitter of transistor N5 connects to the base of a transistor N6. The emitter of transistor N6 connects to the resistor R2 which is connected to ground. Thus, the voltage at the base of transistor N1 equals the sum of the base emitter voltages of transistors N1, N5 and N6 and the voltage across the resistor R2.

In order to determine the other side of the equation of the circuit of the present invention, the transistor N2 is connected as a Darlington pair with transistor N3. The collectors of transistors N2 and N3 are connected to one another. The emitter of transistor N2 is connected to the base of transistor N3. The emitter of transistor N3 connects to the base of transistor N4. The emitter of transistor N4 is connected to ground. Thus, on the other side of the equation the voltage at the base of transistors N1 and N2 is equal to the base emitter voltages of transistors N2, N3 and N4.

Since the collector currents in transistors N1 and N4 are nearly equal, they can be subtracted from the equation. Thus, the voltage across resistor R2 is equal to the difference in base emitter voltages of transistors N3 and N6 plus the difference in base emitter voltages of transistors N2 and N5. The emitter area of transistor N3 is twice that of the emitter area of either transistor N2 or transistor N5. The emitter area of transistor N6 is twelve times the emitter area for either of the transistors N2 or N5. In other words, the emitter area of transistor N6 is six times that of transistor N3.

Transistor N3 and transistor N6 operate at the same collector current level. Consequently, their base currents are approximately equal. Transistor N5's collector current is about equal to transistor N6's base current while transistor N2's collector current is about equal to the base current of transistor N3 and transistor N6. The base currents of transistor N3 and transistor N6 being equal, the collector current through transistor N2 is going to be twice that of the collector current of transistor N5. For transistors with the same emitter area the ΔVbe can be determined by the equation $\Delta Vbe=(kt/Q)\ln(I_{N2}/I_{N5})=0.69\ V_t$. At 25° C., this equals 17.8 mv.

Since the collector currents for transistors N6 and N3 are roughly equal, the Vbe for transistors N6 and N3 is a function of the relative areas of their emitters. $Vbe=(kT/Q)\ln(A_E(N6)/A_E(N3))=V_t\ln(12/2)=1.79\ V_t$. This works out to 46.0 mV at 25° C.

The reference current in the prior art is used as the base current for transistors N1 and N3. The amount of input current required is determined by the relationship between the output current and the beta of transistor N3. In the circuit of the present invention, the transistor N3 is buffered by transistor N2 so that the base current required from the reference current is reduced by the factor of the beta of transistor N2. Thus, the reference current needs have been reduced approximately on the order of a factor of 100.

Transistor N5 is included in the circuit to maintain the voltage relationships which provide a positive temperature coefficient current source. The collector of transistor N5 could be connected to a regulated line or to the collector of transistor N2 rather than the preferred connection to the emitter of transistor N2. However, such a connection eliminates the ΔVbe of transistors N2 and N5. The contribution of these transistors would be zero to the equation since the two transistors in this alternate embodiment would be operating at equal current levels.

In the circuit of the present invention, the voltage across resistor R2 is still determined solely by factors dependent on the ΔVbe's of the transistors Thus, the circuit contains a positive temperature coefficient This has been accomplished with the added benefit that the reference current requirements have been reduced by a factor of the beta of transistor N2.

Of course, it should be understood that various changes and modifications to the preferred embodiment described above will be apparent to those skilled in the art. For example, the ratio of the emitter areas of transistors N6, N3, N5 and N2 may be changed while still preserving the circuit layout and advantages of the present invention. It is therefore intended that such changes and modifications be covered by the following claims.

I claim:

1. A positive temperature coefficient current source comprising:

a first transistor having a collector for receiving a reference current, a base connected to the collector and an emitter;

a second transistor having a base connected to the base of said first transistor, a collector and an emitter;

a third transistor having a base connected to the emitter of said second transistor, a collector connected to the collector of said second transistor and an emitter;

a fourth transistor having a collector connected to the emitter of said first transistor, a base connected to the emitter of said third transistor and an emitter connected to ground;

a fifth transistor having a base connected to the emitter of said first transistor, a collector and an emitter;

a sixth transistor having a base connected to the emitter of said fifth transistor, a collector connected to the emitter of said third transistor and an emitter; and a resistor connected between the emitter of said sixth transistor and ground.

2. The current source of claim 1 wherein the emitter of said sixth transistor has an area and the emitter of said third transistor has an area such that the area of the emitter of said sixth transistor is larger than the area of the emitter of said third transistor.

3. The current source of claim 2 wherein the emitter of said sixth transistor is six times as large as the area of the emitter of said third transistor.

4. The current source of claim 1 wherein the collector of said fifth transistor is connected to the emitter of said second transistor.

5. A positive temperature coefficient current source comprising:

a first transistor having a collector for receiving a reference current, a base connected to the collector and an emitter;

a second transistor having a base connected to the collector of said first transistor, a collector and an emitter;

a third transistor having a base connected to the emitter of said second transistor, a collector connected to the collector of said second transistor and an emitter;

a fourth transistor having a collector connected to the emitter of said first transistor, a base connected to the emitter of said third transistor and an emitter connected to ground;

a fifth transistor having a base connected to the emitter of said first transistor, a collector connected to the base of said third transistor and an emitter;

a sixth transistor having a base connected to the emitter of said fifth transistor, a collector connected to the emitter of said third transistor and an emitter; and a resistor connected between the emitter of said sixth transistor and ground.

6. The current source of claim 5 wherein the emitter of said sixth transistor has an area and the emitter of said third transistor has an area such that the area of the emitter of said sixth transistor is larger than the area of the emitter of said third transistor.

7. The current source of claim 6 wherein the emitter of said sixth transistor is six times as large as the area of the emitter of said third transistor.

* * * * *